United States Patent [19]

Pue

[11] 4,335,432

[45] Jun. 15, 1982

[54] OPTIMAL VEHICLE FOLLOWING CONTROL SYSTEM

[75] Inventor: Alan J. Pue, Columbia, Md.

[73] Assignee: United States of America, Washington, D.C.

[21] Appl. No.: 115,651

[22] Filed: Jan. 28, 1980

[51] Int. Cl.[3] ..... B61L 23/00

[52] U.S. Cl. ..... 364/436; 364/438; 246/187 C

[58] Field of Search ..... 364/436, 437, 438, 424; 246/187 C; 180/168, 170

[56] References Cited

U.S. PATENT DOCUMENTS

| | | | |
|---|---|---|---|
| 3,764,985 | 10/1973 | Hochreiter | 180/170 |
| 3,790,780 | 2/1974 | Helmcke et al. | 246/187 C |
| 3,817,344 | 6/1974 | Asano et al. | 180/170 |
| 3,891,168 | 6/1975 | Kraus | 246/187 C |
| 3,953,714 | 4/1976 | Gabillard | 364/436 |
| 4,007,897 | 2/1977 | Auer, Jr. | 364/436 |
| 4,015,804 | 4/1977 | Dobler et al. | 364/436 |
| 4,023,753 | 5/1977 | Dobler | 364/436 |
| 4,123,023 | 10/1978 | Nelson | 364/436 |

OTHER PUBLICATIONS

Chiu et al., "Vehicle-Follower Control with Variable-Gains for Short Headway Automated Guideway Transit Systems", *ASME Journal of Dynamic Systems, Measurement, and Control,* vol. 99, Sep. 1977, pp. 183-189.

Pue A. J., "A State-Constrained Approach to Vehicle-Follower Control for Short Headway AGT Systems", *APL/JHU Report*, No. TPR-038, Aug. 1977.

Pue A J., "A State-Constrained Approach to Vehicle-Follower Control for Short Headway Automated Transit Systems", *Journal of Dynamic Systems, Measurement and Control,* vol. 100, Dec. 1978, pp. 291-297.

Brown S. J., Jr., "Design of Car-Following Type Control Systems with Finite Bandwidth Plants," *Proc. Seventh Annual Princeton Conference on Information Science and Systems,* Mar. 1973, pp. 59-62.

Caudill et al., "Vehicle-Follower Longitudinal Control for Automated Transit Vehicles", *ASME Journal of Dynamic Systems, Measurement and Control,* vol. 99, No. 4, Dec. 1977, pp. 241-248.

*Primary Examiner*—Mark E. Nusbaum
*Assistant Examiner*—Gary Chin
*Attorney, Agent, or Firm*—Otto M. Wildensteiner; Harold P. Deeley, Jr.; Robert E. Archibald

[57] ABSTRACT

A vehicle-follower control law for short headway automated guideway transit systems is implemented to provide an apparently optimal system in light of sensor accuracy, controller structure, and data transmission requirements. In particular, the spacing between two vehicles on a guideway is forced to an approximate optimal minimum value ($S'_{min}$) by generating a signal ($\epsilon$) which is the difference between the actual spacing (S) and the approximate optimal minimum spacing ($S'_{min}$) and by driving the signal $\epsilon$ to zero according to a predetermined control law. In accordance with the invention, a constant headway or constant K-factor design can be employed in defining the control law. Embodiments for 0.5 second and 3 second headways are provided.

9 Claims, 4 Drawing Figures

OPTIMAL VEHICLE FOLLOWING CONTROL SYSTEM

BACKGROUND OF THE INVENTION

Two basic approaches have been employed for the longitudinal control of vehicles in automated guideway transit systems. The approach, termed "vehicle following", allows communication between successive vehicles so that the motion of a given vehicle is controlled in accordance with the motion of a preceding vehicle. This approach contrasts with "point-following" which assigns a vehicle to a cell (or slot), the cells being propagated along the guideway network at predetermined velocities and spacings. In point-following, propulsion commands are generated to maintain the vehicle's location within the assigned cells.

Several investigators have studied the feasibility of the vehicle following approach by using a linear, time-invariant regulator to control perturbations from a nominal operating condition. Levine and Athans in "On the Optimal Error Regulation of a String of Moving Vehicles", IEEE Transactions, Vol. AC-11, No. 3, July 1966, use a linear optimal regulator to design a system where each vehicle generates propulsion commands based on information from all other vehicles in a string. In another article, "On the Optimal and Suboptimal Position and Velocity Control of a String of High Speed Moving Trains", M.I.T. Electronic Systems Laboratory, Report PB 173640, November 1966, Athans, et al reduce the complexity of this technique by applying the optimization procedure of Levine and Athans to smaller overlapping strings. Finally, Cunningham and Hinman in "An Approach to Velocity Spacing Regulation and the Merging Problem in Automated Transportation", Joint Transportation Engineering Conference, Chicago, Ill., October 1970, reduce the scheme to one in which vehicle control is based only on vehicle state and the state of the immediately preceding vehicle. This strategy is pursued by Brown in "Design of Car-Following Type Control Systems with Finite Bandwidth Plants", Proceedings of the Seventh Annual Princeton Conference on Information Sciences and Systems, March 1973 while Fenton in "Fundamental Studies in the Automatic Longitudinal Control of Vehicle", DOT-TST-76-79, July 1975, deals with the design and testing of hardware systems. In "Vehicle-Follower Longitudinal Control for Automated Transit Vehicles", ASME Journal of Dynamic Systems, Measurement, and Control, Volume 99, Number 4, December 1977, Caudill and Garrard Study the effects of spacing policy and system nonlinearities upon string stability for vehicles operating under vehicle following.

The above studies of vehicle following have focused on the regulation of vehicle speeds and spacings during perturbations about normal values. It has been shown that suitable control can be obtained using properly designed, constant-gain linear regulator laws. However, in general, a control capability must exist to perform transient manuevers such as overtaking a slower moving vehicle, switching from an open-loop velocity command mode to the regulation mode, merging vehicles both on the main line and from stations, and generating gaps in vehicle flows during such merging operations. This was first recognized by Stupp et al in "Vehicle-Follower Control with Variable-Gains for Short Headway Automated Guideway Transit Systems", ASME Journal of Dynamic Systems, Measurement, and Control, Volume 99, September 1977.

In Stupp where it was shown that at time headways of less than approximately five seconds, a fundamental kinematic constraint arises which creates bounds on vehicle motion. This constraint dictates a minimum allowable spacing between vehicles which is a function of trailing vehicle state, preceding vehicle state, and the future maneuver capability of each vehicle. As a result, the bandwidth requirement for the closed loop regulator at short headways is inconsistent with the large initial values of vehicle motion, i.e., the system response to these initial conditions typically leads to violation of comfort criteria and the kinematically required spacing.

SUMMARY OF THE INVENTION

The state-constrained approach of the present invention incorporates the kinematic constraint function (an inequality constraint on the state variables) into the control law. The kinematic constraint (our performance criterion for transient phenomena) and a quadratic performance index (the criterion for steady-state perturbational phenomena) may be combined into an optimal control problem. The solution to such a problem, however, is complex and requires considerable computation. According to the invention, a less complex approximate solution is employed that is easier to implement. The approximate solution is conceptually based, but differs and expands upon, a procedure derived by Sardis in "Design of Approximately Optimal Feedback Controller for Systems with Bounded States"[IEEE Transactions on Automatic Control, Volume AC-12, Number 4, August 1967.

The application of the state-constrained technique of the present invention to the vehicle following problem assumes that when the states of the trailing and preceding vehicle are such that violation of the kinematic constraint is not imminent (spacing is sufficiently large) the trailing vehicle may accelerate at its full capability. When the kinematic constraint is being violated (spacing is too small) the vehicle is commanded to brake at its full service (nominal) capability. The essence of the invention is that when vehicle spacing is equal to the kinematically required spacing a control is introduced which tends to maintain the desired spacing. However, the computation and information requirements for computing the appropriate control is extensive and hence, the control law is simplified to produce a practical controller.

The first simplification is to eliminate the logical switching involved in following the actual kinematic constraint. This simplification of the controller requires some modification of the kinematic constraint but has little impact on performance. But even with such simplification the informational requirements for precisely maintaining the kinematically required spacing include preceding vehicle velocity, acceleration, and jerk. To overcome this drawback, the present invention employs several suboptimal controllers for simplifying the kinematic constraint such that the resulting control will satisfy the actual kinematic constraint but will require less computation and information. The final result is an easily instrumentable controller requiring preceding vehicle information in the form of spacing and its derivatives (i.e., relative velocity and acceleration) only. Moreover, the control law is suitable for all of the possible transient maneuvers previously listed and assures that all possible nominal vehicle maneuvers are safely executed within service (as opposed to emergency) limits on acceleration and jerk. Additional objectives met by this invention are as follows.

According to the kinematic constraint, the trailing vehicle must maintain a spacing such that if the preceding vehicle should perform a minimum-time deceleration maneuver, the trailing vehicle may react with its full service braking capability and avoid collision. The invention achieves this object in near optimal fashion. That is, the spacing between vehicles is maintained at the minimum distance necessary to permit safe and comfortable operation during any nonemergency maneuver of a preceding vehicle.

String stability is also an object of the present invention. A string of vehicles must be controlled without a magnification of disturbances along the string. In order to determine the appropriate gains and delays, z transform analysis and computer simulation studies are used to assure a string stable design.

It is also an object of the present invention to provide either a constant headway or constant K-factor design with a corresponding reduction in velocity error gain as these values increase. This feature results in reducing the required control bandwidth and relaxing data rate and time delay requirements.

The state constraints inherent in the present vehicle following strategy are expressed as part of the control scheme. The resulting controller is a nonlinear function of states which constitutes an improved way of effecting transitions between modes of operation normally designed into a vehicle following system. It is an object of the invention to continuously follow the constraints with one controller rather than switching between a plurality of controllers depending on whether the constraints are active or inactive. Consequently, another object of the invention is to provide a general formulation and systematic approach which may be applied to various situations such as the merging and injecting of vehicles onto a guideway.

The present invention achieves many of the objectives discussed in a report prepared by the inventor for the Department of Transportation. The report, "A State-Constrained Approach to Vehicle-Follower Control for Short-Headway AGT Systems", APL/JHU CP 058/TPR 038 (August 1977), discusses various features ancillary to the invention. The present invention, in addition, improves on the system set forth in the report in several significant ways. An uplink information error $\epsilon_w$ which represents the discrepancy between the actual spacing and the desired spacing of vehicles includes factors not previously considered, in order to permit closer following within constraints. The newly defined $\epsilon_w$ function translates into lower gain, lower sample rate, and longer allowable delay in the implementing circuitry. Cost and complexity are thus reduced while output is enhanced. Also, a value $u_w$ determined in the former systems with an on-board vehicle controller as a function of vehicle velocity and acceleration is, according to the present invention, determined (together with $\epsilon_w$) by a wayside computer and transmitted to the on-board controller in a signal carrying both $\epsilon_w$ and $u_w$. A filter in the on-board controller appropriately channels the signal components. This improvement results in decreased complexity.

In addition to the above-mentioned report, the inventor has written an article, published in December, 1978 in *Transactions of the ASME Journal of Dynamic Systems, Measurement and Control* (Volume 100, page 291 et seq) entitled "A State-Constrained Approach to Vehicle Follower Control for Short Headway Automated Transit Systems" which provides background for the present invention.

Figure 1:
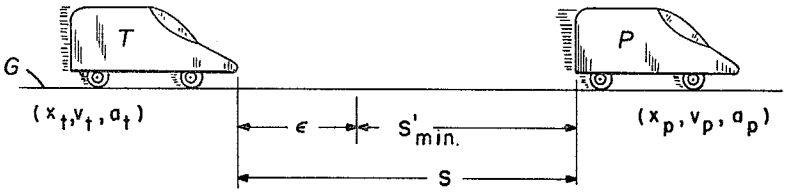
FIG. 1 shows two vehicles and the variables considered in determining their spatial relationship.

DESCRIPTION OF A PREFERRED EMBODIMENT OF THE INVENTION:

Referring to FIG. 1, a preceding vehicle P is followed by a trailing vehicle T on a guideway G. The state of vehicle P is defined by its position $x_p$, its velocity $v_p$, and its acceleration $a_p$. Similarly, the state of trailing vehicle T is defined by its position $x_t$, its velocity $v_t$, and its acceleration $a_t$. The distance, or separation, between the two vehicles is indicated by S. The optimal separation between the two vehicles is referred to as $S_{min}$, while an approximate value used to achieve a practical, implementable control system is referred to as $S'_{min}$. The difference between the actual separation and the approximated optimal separation is referred to as $\epsilon$. The purpose of the present invention is to drive the value of $\epsilon$ to zero for various constant headways (h seconds). In particular, embodiments having a 0.5 second headway which is generally characteristic of a personal rapid transit system and a 3 second headway which is characteristic of a group rapid transit system are set forth.

Figure 2:
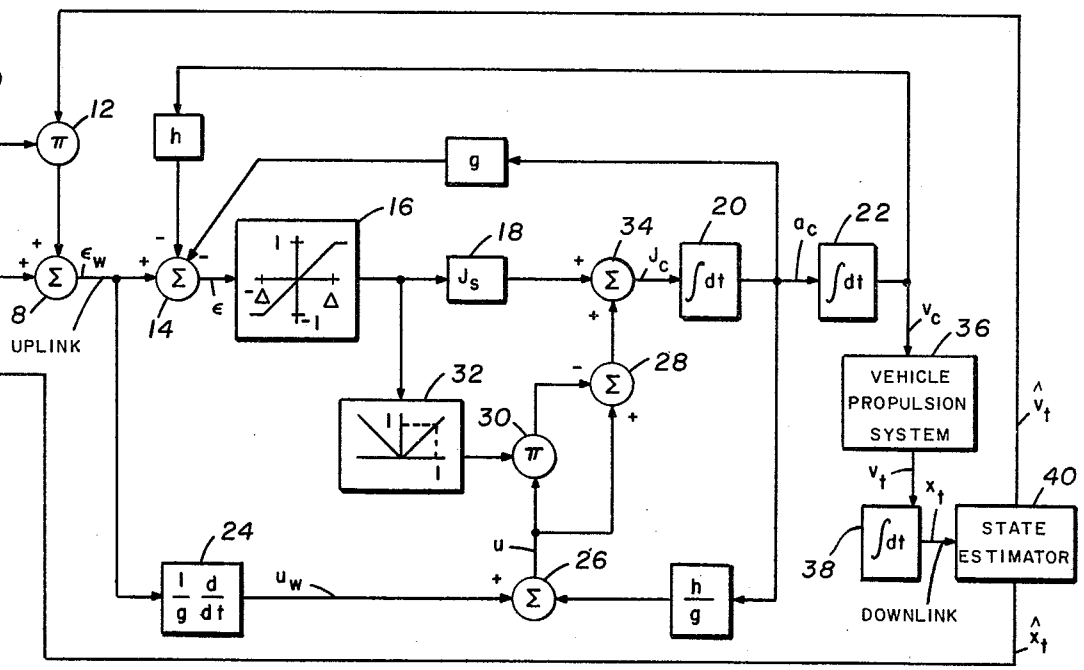
FIG. 2 is a diagram showing the implementation of the control law employed by the present invention.

Referring to FIG. 2, an implementation of the basic control law (particularly adaptable to a 3 second headway) of the present invention is set forth. Signals corresponding to $x_p$ and $\hat{x}_t$ are shown entering a subtractor 2 together with the length of the preceding vehicle L to yield the actual separation S between the vehicles P and T. Given particular jerk and acceleration restraints, namely, 2 mm/sec$^3$ and 1.5 mm/sec$^2$, respectively, a discrepancy value $\epsilon_w$ (based on wayside information) is defined, according to the invention, as:

$$\epsilon_w = S + (5.3 - h)(v_p - v_t) + 0.33 v_t (v_p - v_t) - L$$

The implementation of this definition is shown where the signal corresponding to the spacing S enters a summer 4 while at the same time entering a differentiator-gain element referred to in conventional notation with a (5.3 − h)d/dt in a block 6. The output of block 6 is added to the spacing S in summer 4 the output of which enters another summer 8. Element 10 also receives the output from block 6 as an input and scales it by a factor 0.33/(5.3 − h). The output of gain element 10 is multiplied by a calculated, estimated value of the velocity of the trailing vehicle, $\hat{v}_t$ in a product ($\pi$) element 12. The output of product element 12 enters summer 8 together with the output of summer 4 to yield $\epsilon_w$ as previously defined. It should be noted that the scaling values and constants employed depend on the selected jerk and acceleration limits and headway, and can be varied depending on those limits.

The configuration set forth in FIG. 2 is referred to as "smart" in that control looping for the system is effected, for the most part, on board the vehicle T. Specifically, $\epsilon_w$ enters a combiner 14 which produces a refined $\epsilon$. $\epsilon$ is, in part, a function of acceleration $a_c$ and velocity $v_c$ commands. (These commands $a_c$ and $v_c$ are used to change the state of the trailing vehicle T in such a way as to decrease the absolute value of $\epsilon$.) $\epsilon$ from combiner 14 enters a limiter 16 wherein the value for $\epsilon$ is limited to a value of one when it is either less than minus $\Delta$ or greater than plus $\Delta$, $\Delta$ being a settable limit. The output of limiter 16 enters a jerk factor element 18. When $\epsilon$ is not equal to zero a jerk command $J_c$ is generated which is converted through an integrator 20 into an acceleration command $a_c$. Through another integrator 22, the acceleration command $a_c$ provides a velocity command $v_c$ which is intended to affect the state of the trailing vehicle T. The acceleration command $a_c$ is fed back through a gain element g and is then entered into combiner 14. Also, the velocity command $v_c$ is fed back through a gain element h, where h is the desired headway and is also entered into the combiner 14. Accordingly, $\epsilon$ is then defined as:

$$\epsilon=\epsilon_w-h\ v_c-ga_c$$

A second control variable $u_w$ is provided to maintain $\epsilon$ at zero. $u_w$ corresponds to a scaled derivative of $\epsilon_w$ as suggested in FIG. 2 by a differentiator 24. $u_w$ enters a summer 26 together with a scaled acceleration command, namely, $a_c$ scaled by headway, h, divided by g. The output from summer 26 is u (i.e., a measure of change in $\epsilon$) which enters a subtractor 28 and a product ($\pi$) element 30 simultaneously. The other input to the product element 30 is a switching device 32 which has as its input the output from the limiter 16. In operation, when $\epsilon$ is zero, the output from the switch 32 is zero causing the output from product element 30 to be zero. The element u passes unaltered to and through the subtractor 28 to a summer element 34 where it is added to the jerk signal stimulated by element 18. When $\epsilon$ changes from zero, u, a measure of change in $\epsilon$, causes a jerk change command to exit subtractor 28 and force $\epsilon$ to a zero level. When $\epsilon$ is very large, the output from limiter 16 is 1 or $-1$. According to switch 32, the value of u entering 30 will be multiplied by 1 and will thus enter the subtractor as a negative input. u is also entered into subtractor 28 as a positive input. When $\epsilon$ is very large, the value of u is not considered in generating the jerk command, the output from subtractor 28 being zero. A dual mode operation depending on the value of $\epsilon$ is thus achieved. When the spacing S is far from its optimum ($\epsilon$ is large in magnitude), the system operates in accordance with the imposed jerk limit so as to null $\epsilon$. As S approaches its optimum and kinematic constraints may be violated ($\epsilon$ is small in magnitude), the system assumes its other mode. The selective signal from element 32 effects this dual modality.

Once generated, the velocity command $v_c$ enters a vehicle propulsion system 36 of vehicle T. The command is integrated into the vehicle T to either increase or decrease its speed. The new speed of the trailing vehicle T is measured by sensor and is indicated as $v_t$. $v_t$ is then either integrated in a filter 38 which provides a position output $x_t$ or $x_t$ may be measured directly by sensors. $x_t$ enters a state estimator 40 which produces estimated position and velocity values $\hat{x}_t$ and $\hat{v}_t$ for the trailing vehicle T. The value of $\hat{x}_t$ is fed back to subtractor 2 where a new value for the spacing S can be determined.

In accordance with the present invention, two configurations are suggested depending on the desired headway. For a system having a 3-second headway, the value for $u_w$ is obtained by simply differentiating $\epsilon_w$:

$$u_w=\frac{1}{g}\ \frac{d}{dt}\ \epsilon_w.$$

Figure 3:
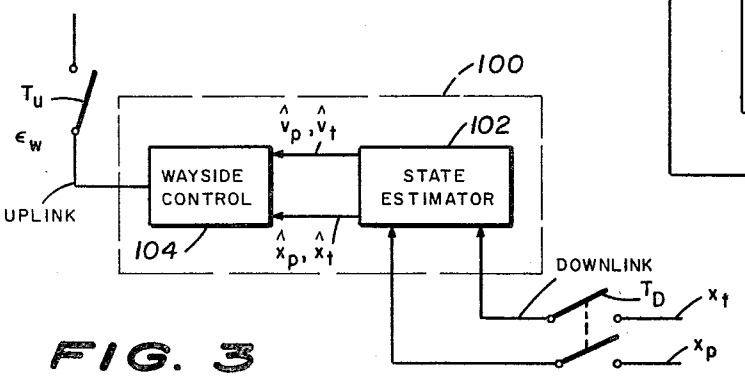
FIG. 3 is a diagram showing elements which generate a variable $\epsilon_w$ used in controlling relative vehicle position in a 3-second headway embodiment of the invention.

In effectuating this configuration, the arrangement of FIG. 3 is employed. Interposed between $x_t$ and $\epsilon_w$ in this 3-second headway embodiment is a wayside computer 100 which includes the state estimator 102 and a wayside control 104. The state estimator 102 is a conventional Kalman filter which receives as inputs the position of the trailing vehicle $x_t$ and the position of the preceding vehicle $x_p$ as they are sensed by either the respective vehicles or wayside equipment. The signals are downlinked at a rate determined by a switch $T_D$. The state estimator 102 generates velocity estimates $\hat{v}_p$ and $\hat{v}_t$ and position estimates $\hat{x}_p$ and $\hat{x}_t$ which provide more precise values for the state variables. The estimated values enter the wayside control 104 which uplinks $\epsilon_w$, which is equal to $$[\hat{x}_p-\hat{x}_t+(5.3-h)(\hat{v}_p-\hat{v}_t)+0.33\hat{v}_t(\hat{v}_p-\hat{v}_t)-L],$$

to the vehicle T at a sampling interval $T_u$. In accordance with this embodiment, the control variable u is calculated on-board the vehicle T by differentiating $\epsilon_w$, as shown by block 24 of FIG. 2 which represents a differentiator in this embodiment. With the 3 second headway, only $\epsilon_w$ need be computed and transmitted. No explicit acceleration estimates are required. However, the differentiation of $\epsilon_w$ to derive $u_w$ requires noise filtering and thus degrades performance. Although satisfactory where headway h is 3 seconds this degradation proves unacceptable as h=0.5 seconds.

Figure 4:
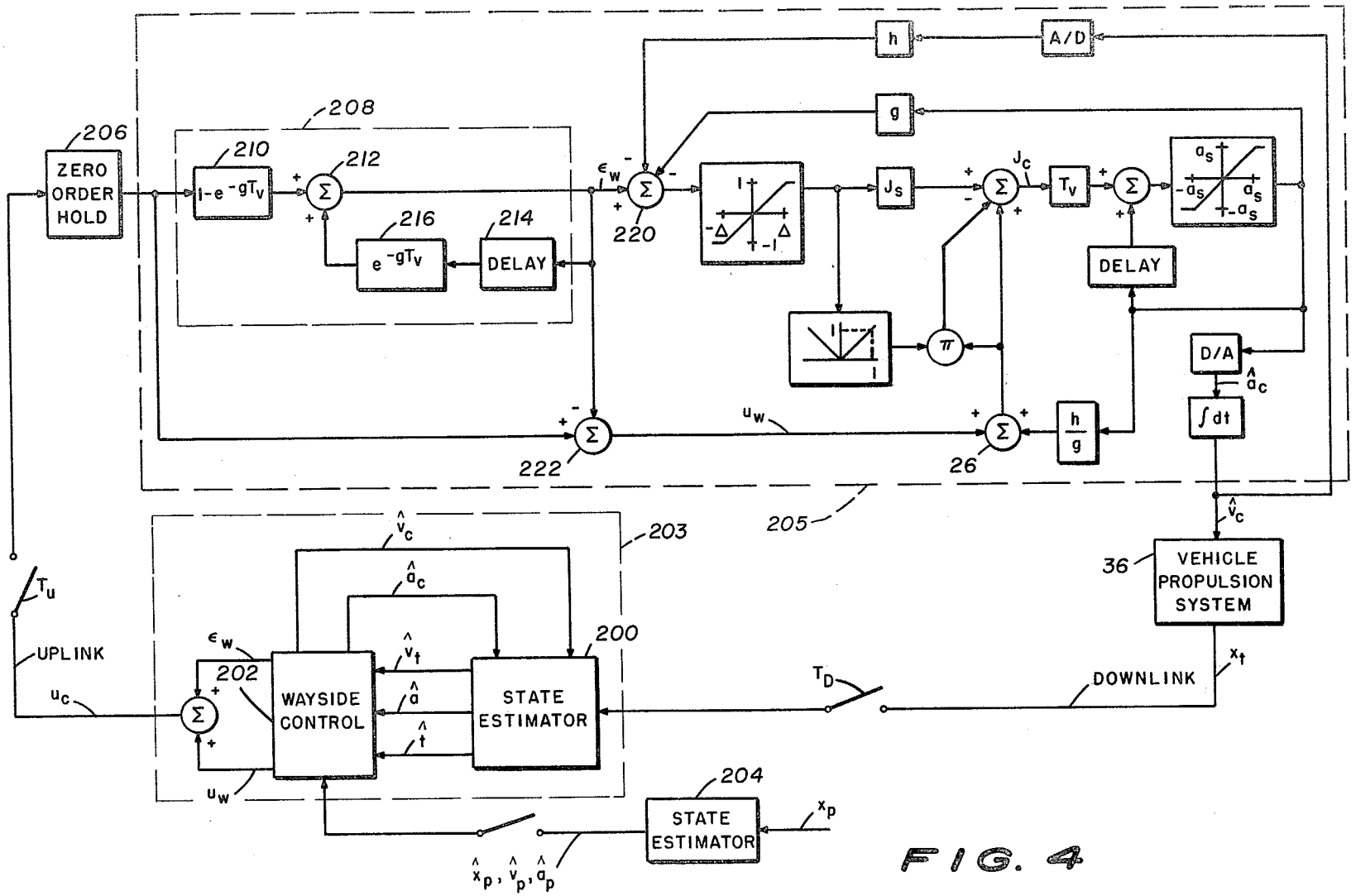
FIG. 4 shows a diagram implementing the control law of a 0.5-second headway embodiment of the invention.

In effectuating the 0.5-second headway, the configuration shown in FIG. 4 provides numerous advantages. First, the value $u_w$ is defined as:

$$u_w=(1/g)[(\hat{v}_p-\hat{v}_t)+(5.3-h)(\hat{a}_p-\hat{a}_t)+0.33\hat{a}_t(\hat{v}_p-\hat{v}_t)+0.33\hat{v}_t(\hat{a}_p-\hat{a}_t)].$$

where ( ^ ) represents estimated value of the respective quantities. The uplink command $(u_w+\epsilon_w)$, or $u_c$, then becomes $(1/g\ s+1)\epsilon_w$ where S is the conventional La-Place notation representing differentiation. Onboard the trailing vehicle T, $\epsilon_w$ can be readily retrieved as:

$$\epsilon_w=\frac{1}{\frac{1}{g}s+1}\ u_c.$$

where $u_w=u_c-\epsilon_w$. This configuration obviates onboard differentiation and for proper initialization and requires only one piece of information, i.e., $u_c$, for uplink.

Referring to FIG. 4, a position measurement signal $x_t$ is derived from the vehicle propulsion system 36 and downlinked at a sampling interval $T_D$. The sampled $x_t$ signal enters a state estimator 200 which differs from the state estimator 102 of FIG. 3 but also interpolates states between samples and reduces noise. In addition to the sampled $x_t$ signal, estimated velocity $\hat{v}_c$ and acceleration $\hat{a}_c$ commands are fed into the state estimator 200. The state estimator 200 is basically a Kalman filter which produces an estimated desired position $\hat{x}_t$, velocity $\hat{v}_t$, and acceleration $\hat{a}_t$ output. The estimated outputs of the trailing vehicle T enter a wayside control 202 of computer 203 together with the estimated position $\hat{x}_p$, velocity $\hat{v}_p$, and acceleration $\hat{a}_p$ states of the preceding vehicle P derived from the sensed $x_p$ processed through a state estimator 204. From the estimated states for vehicles P and vehicle T, the wayside control 202 generates the aforementioned uplink command $u_c$ as well as estimated velocity $\hat{v}_c$ and acceleration $\hat{a}_c$ commands. The estimated commands $\hat{v}_c$ and $\hat{a}_c$ are obtained via a duplicate on-board control computation from on-board controller 205 and are used in generating inputs to the state estimator 200.

The wayside control 202 also generates an $\epsilon_w$ signal and a $u_w$ signal based on the estimated state inputs for the trailing vehicle T and preceding vehicle P. The two signals are combined into a single signal $(\epsilon_w+u_w)$ for uplink transmission. The uplink transmission is sampled at an interval $T_u$. Between intervals the previous $(\epsilon_w+u_w)$ signal is stored in a zero order hold element 206. A filter 208 includes a first exponential function gain element 210 which multiplies the $(\epsilon_w+u_w)$ signal by $1-e^{-gT}v$ where $T_v$ is the onboard computation interval. The output of gain element 210 enters a summer 212 the output from which is $\epsilon_w$. The $\epsilon_w$ output is fed back to summer 212 after being delayed by an interval $T_v$ in element 214 and passing through a second exponential gain element 216 which multiplies the $\epsilon_w$ signal by $e^{-gT}v$. When combined, the inputs to summer 212 yield $\epsilon_w$ which can then be provided to combiner 220 (shown in FIG. 2 as 14) and to an element 222 which subtracts $\epsilon_w$ from the signal $(\epsilon_w+u_w)$ to produce $u_w$. As indicated in FIG. 4, $u_w$ enters the summer 222 (shown also in FIG. 2). The FIG. 4 embodiment, as previously discussed, by employing the subtractor element 222 rather than a differentiator as in FIG. 3, avoids noise and enhances performance in the 0.5 second headway embodiment. Except for being defined in digital terms, the remainder of the control in FIG. 4 functions similarly to that described with respect to FIG. 2, i.e., delays and summations being used rather than differentiation and integration filtering, resulting in enhanced 0.5 second headway operation.

Various modifications, adaptations and alterations to the present invention are of course possible in light of the above teachings. It should therefore be understood at this time that within the scope of the appended claims, the invention may be practiced otherwise than was specifically described hereinabove.

What is claimed is:

1. In a vehicle-follower, short headway control system wherein the actual spacing S between a preceding vehicle and a trailing vehicle which travel on a guideway differs from an optimal spacing $S_{min}$ based on kinematic constraints, the combination comprising:

apparatus for generating a signal $\epsilon_w$ which is a component part of a signal $\epsilon$ which is the difference between the actual spacing S and an approximate optimal spacing $S'_{min}$, said signal generating means including, means for determining and conveying a signal corresponding to the actual spacing S, means for differentiating the actual spacing signal S over time and multiplying the derivative signal of the actual spacing signal S by a first gain factor (5.3-headway), means for multiplying the differentiated and multiplied signal by a second gain factor equal to $$\left(\frac{.33}{5.3-\text{headway}}\right),$$

means for providing a signal indicative of the velocity of the trailing vehicle, means for generating the product of the trailing vehicle velocity signal by the output from the second gain factor multiplying means, and means for summing the generated product signal, the actual spacing signal, and the output from the differentiating and multiplying means to provide the $\epsilon_w$ signal, and control means responsive to said $\epsilon_w$ signal for controlling said trailing vehicle to maintain said approximate optimal spacing $S'_{min}$.

2. Apparatus, as in claim 1, wherein the velocity of the trailing vehicle is controllable, the apparatus further comprising:

means for generating a current acceleration command and a current velocity command wherein the current velocity command is fed to the trailing vehicle, and means for refining $\epsilon_w$ which comprises:

means for multiplying a most recent previous acceleration command by a third gain factor, means for multiplying a most recent previous velocity command by the headway factor, and means for subtracting from the generated $\epsilon_w$ signal function both the output from the third gain factor multiplying means and the output from the headway factor multiplying means.

3. Apparatus, as in claim 2, further comprising:

means for generating a signal, $u_w$, corresponding to the change in $\epsilon_w$ over time, and means for changing the acceleration and velocity commands as a function of the $u_w$ signal.

4. Apparatus, as in claim 3, wherein the headway is three seconds and wherein the means for generating the $u_w$ signal comprises:

means for producing a signal corresponding to the time derivative of $\epsilon_w$ divided by the third gain factor.

5. In a vehicle-follower, short headway control system having a preceding and a trailing vehicle, the combination comprising:

apparatus for generating a current jerk command signal $J_c$, including, integrating means for deriving a previous acceleration command signal $a_c$ and a previous velocity command signal $v_c$ from a previous jerk command signal;

means for multiplying the signal $a_c$ by a gain factor g and for multiplying the signal $v_c$ by a headway factor h;

wayside control means for transmitting information;

means for generating a signal $\epsilon_w$ corresponding to the difference between the actual spacing S between the two vehicles and an approximate optimal spacing $S'_{min}$, the signal $\epsilon_w$ being generated based on received information transmitted by the wayside control means, means for multiplying signal $a_c$ by a factor h/g;

means for generating the derivative of the signal $\epsilon_w$ and for multiplying the derivative by a factor 1/g to provide a signal $u_w$;

means for subtracting the signal $hv_c$ and the signal $ga_c$ from $\epsilon_w$ to provide a signal $\epsilon$;

nonlinear limiter means, having $\epsilon$ from the subtracting means as an input and having as an output:

(1) $\epsilon$ when $-1<\epsilon>1$ (2) $-1$ when $\epsilon<-1$ (3) 1 when $1<\epsilon$ means for receiving and deriving the absolute value of the nonlinear limiter means output;

means for applying a jerk factor $J_s$ to the output from the nonlinear limiter means to provide a first jerk component;

means for summing the signal $u_w$ with the signal h/g $a_c$ to provide a signal u;

means for multiplying the signal u by the output from the absolute value deriving means and for subtracting the product from the signal u to provide a second jerk component; and summing means for combining the first jerk component with the second jerk component to provide the current jerk command signal $J_c$, and control means responsive to said current jerk command signal $J_c$ for controlling said trailing vehicle.

6. In a vehicle-follower, short headway control system wherein the actual spacing S between a preceding vehicle, having a sensed position input, and a trailing vehicle, having a sensed position input, differs from an optimal spacing $S_{min}$ based on kinematic constraints, apparatus for controlling said trailing vehicle to maintain an approximate optimal spacing $S'_{min}$ in response to a signal $\epsilon_w$ which is a function of the difference between the actual spacing S and the approximate optimal spacing $S'_{min}$, based on estimated values of the trailing vehicle's velocity ($\hat{v}_t$) and position ($\hat{x}_t$) and the preceding vehicle's velocity ($\hat{v}_p$) and position ($\hat{x}_p$), said control apparatus comprising:

wayside computing means for generating the $\epsilon_w$ signal according to the equation $$\epsilon_w=\hat{x}_p-\hat{x}_t+(5.3-h)(\hat{v}_p-\hat{v}_t)+0.33\hat{v}_t(\hat{v}_p-\hat{v}_t)-L,$$

where h=desired headway (seconds), and L=length of preceding vehicle;

means for generating acceleration and velocity commands in response to changes in $\epsilon_w$, the commands generating means comprising an on-board controller on the trailing vehicle; and means for communicating the $\epsilon_w$ signal from the wayside computing means to said on-board controller.

7. Apparatus, as in claim 6, wherein the wayside computing means comprises:

state estimator means for continuously providing, with reduced noise, estimated state variable values of the position, velocity, and acceleration of each vehicle in response to corresponding position inputs for each vehicle, and wayside control means, having the estimated position, velocity, and acceleration signal values as inputs, for producing the $\epsilon_w$ signal function and the $u_w$ time derivative signal.

8. In a vehicle-follower, short headway control system wherein the actual spacing S between a preceding vehicle, having a sensed position input, and a trailing vehicle, having a sensed position input, differs from an optimal spacing $S_{min}$ based on kinematic constraints, apparatus for generating a signal $u_w$ which is a function of the difference between the actual spacing S and the approximate optimal spacing $S'_{min}$ based on the estimated values of the trailing vehicle's acceleration ($\hat{a}_t$), velocity ($\hat{v}_t$) and position ($\hat{x}_t$) and the preceding vehicle's acceleration ($\hat{a}_p$), velocity ($\hat{v}_p$) and position ($\hat{x}_{p'}$), said signal generating apparatus including:

wayside computing means for (a) generating an $\epsilon_w$ signal which is a function of the difference between the actual spacing S and the approximate optimal spacing $S'_{min}$ according to the equation $$\epsilon_w=\hat{x}_p-\hat{x}_t+(5.3-h)(\hat{v}_p-\hat{v}_t)+0.33v_t(\hat{v}_p-\hat{v}_t)-L,$$

where h=desired headway (seconds), and L=length of preceding vehicle (b) generating a $u_w$ signal according to the equation $$u_w=1/g[(\hat{v}_p-\hat{v}_t)+(5.3-h)(\hat{a}_p-\hat{a}_t)+0.33\hat{a}_t(\hat{v}_p-\hat{v}_t)+0.33\hat{v}_t(\hat{a}_p-\hat{a}_t)]$$

where g=a constant, and (c) adding the $\epsilon_w$ signal and the $u_w$ signal together to form signal $u_c=\epsilon_w+u_w$;

means on-board the trailing vehicle comprising means for generating acceleration and velocity commands to control the trailing vehicle in response to the signal $u_c$; and means for communicating the $u_c$ signal from the wayside computing means to the on-board means.

9. In a vehicle-follower, short headway control system for controlling more than two vehicles following each other along a guideway, the apparatus as specified in claim 1, 6, or 8 for generating the corresponding $\epsilon_w$ for each pair of consecutive vehicles and for controlling the trailing vehicle in each pair to maintain the approximate optimal spacing $S'_{min}$ with the preceding vehicle in said pair.

* * * * *